US006843642B2

(12) United States Patent
Hung

(10) Patent No.: US 6,843,642 B2
(45) Date of Patent: Jan. 18, 2005

(54) AIR COMPRESSOR WITH SHOCK-ABSORPTION RUBBER STRIPS AT A BOTTOM THEREOF

(76) Inventor: Victor Hung, 9-16, Nan Kan Hsia, Nan Kan, Lu Chu Hsiang, Tao Yuan County (TW)

( * ) Notice: Subject to any disclaimer, the term of this patent is extended or adjusted under 35 U.S.C. 154(b) by 49 days.

(21) Appl. No.: 10/298,547

(22) Filed: Nov. 19, 2002

(65) Prior Publication Data

US 2004/0096340 A1 May 20, 2004

(51) Int. Cl.[7] ..... F04B 35/00
(52) U.S. Cl. ..... 417/363
(58) Field of Search ..... 417/363, 234, 417/423.14; D12/159

(56) References Cited

U.S. PATENT DOCUMENTS 2,160,278 A * 5/1939 Ness et al. ..... 417/371
4,086,037 A * 4/1978 Stewart ..... 417/571
4,424,006 A * 1/1984 Armbruster ..... 417/234
5,052,904 A * 10/1991 Itakura et al. ..... 417/363
6,174,142 B1 * 1/2001 Holt ..... 417/363

FOREIGN PATENT DOCUMENTS

DE 4441852 * 5/1996

* cited by examiner

*Primary Examiner*—Charles G. Freay
(74) *Attorney, Agent, or Firm*—Alan D. Kamrath; Nikolai & Mersereau, P.A.

(57) ABSTRACT

An air compressor with shock-absorption rubber strips at a bottom thereof, wherein the air compressor has an air compressor. At least one shock-absorption rubber strip is installed to the air compressor bottom plate; the shock-absorption rubber strip is firmly secured to the air compressor bottom plate. The shock-absorption rubber strip is installed with a plurality of elastic foot pad so that when the air compressor is actuated, the elastic foot pad will absorb the shock of a casing of the air compressor.

3 Claims, 9 Drawing Sheets

AIR COMPRESSOR WITH SHOCK-ABSORPTION RUBBER STRIPS AT A BOTTOM THEREOF

BACKGROUND OF THE INVENTION (a) Field of the Invention

The present invention relates to an air compressor with shock-absorption rubber strips at a bottom thereof, where the air compressor bottom plate is combined to at least one shock-absorption rubber strip so as to assure that the air compressor will not move when the air compressor is actuated.

(b) Description of the Prior Art

When a prior art air compressor is actuated, the components will vibrate so that it is possible that the air compressor will displace. However, this is undesirable, especially as the air compressor is placed on the rear cover of a car engine or is installed at a higher place. In actuation, the casing of the air compressor will fall down due to the vibration.

SUMMARY OF THE INVENTION

Accordingly, the primary object of the present invention is to provide an air compressor with shock-absorption rubber strips at a bottom thereof. The air compressor comprises an air compressor. At least one shock-absorption rubber strip is installed to the air compressor bottom plate; the shock-absorption rubber strip is firmly secured to the air compressor bottom plate. The shock-absorption rubber strip is installed with a plurality of elastic foot pad so that when the air compressor is actuated, the elastic foot pad will absorb the shock of a casing of the air compressor.

Moreover, the shock-absorption rubber strips can be combined to the air compressor bottom plate straightly, transversally or obliquely. Moreover, the shock-absorption rubber strip may be arranged with a cross form and then is combined to the air compressor bottom plate so that as the air compressor 1 is actuated, the air compressor absorbs the vibration of the casing as to achieve the object of no displacement.

DETAILED DESCRIPTION OF THE PREFERRED EMBODIMENTS

Figure 1:
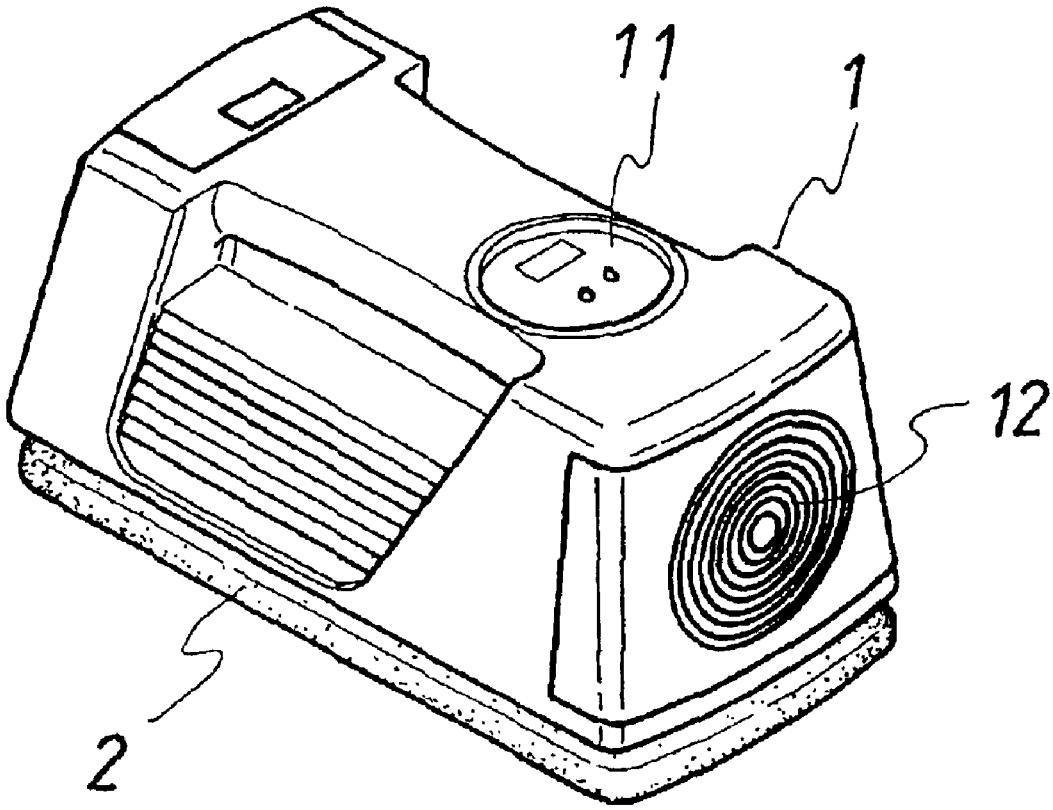
FIG. 1 is an assembled perspective view of the first embodiment of the present invention.
Figure 2:
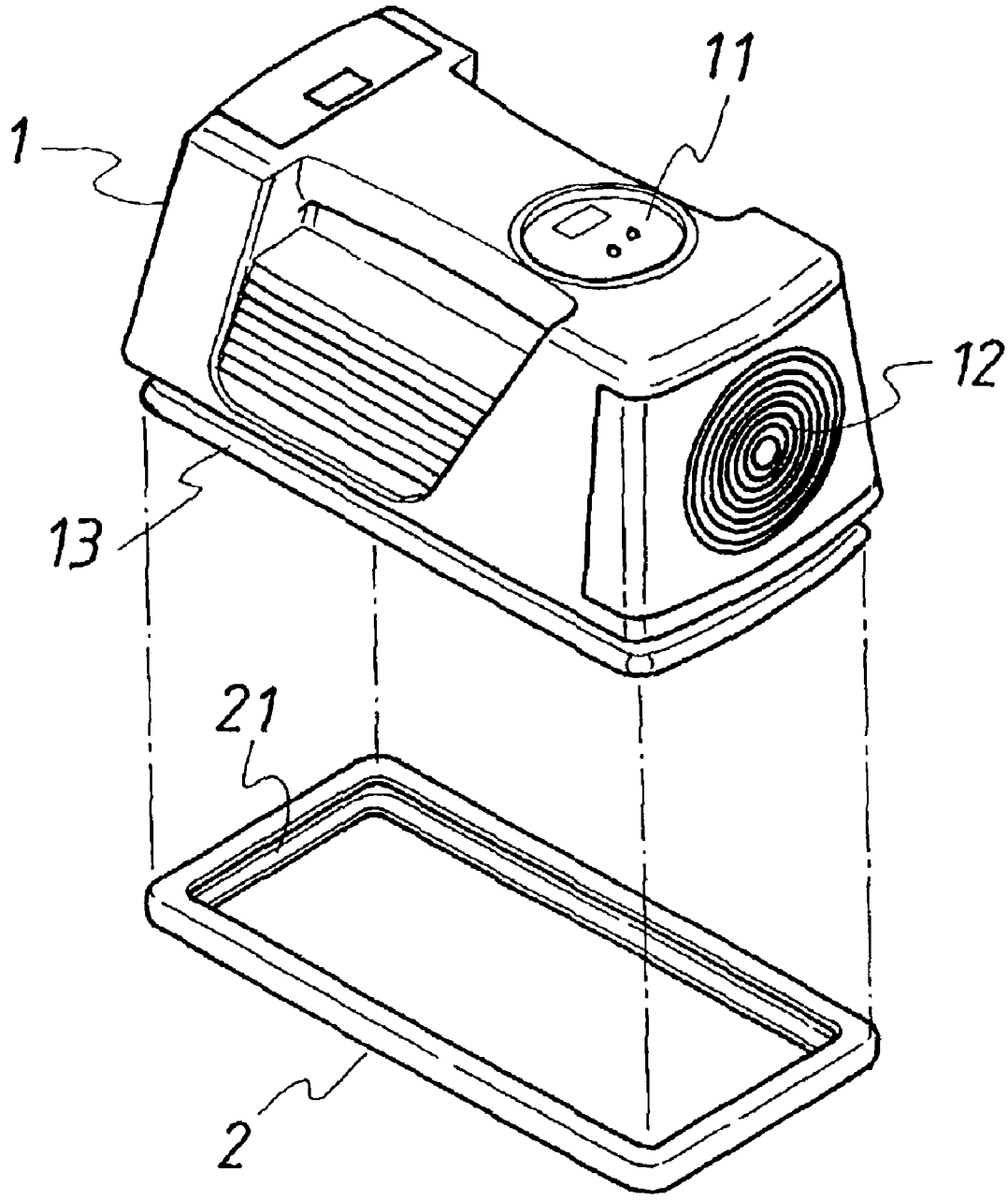
FIG. 2 is an exploded perspective view of FIG. 1.
Figure 3:
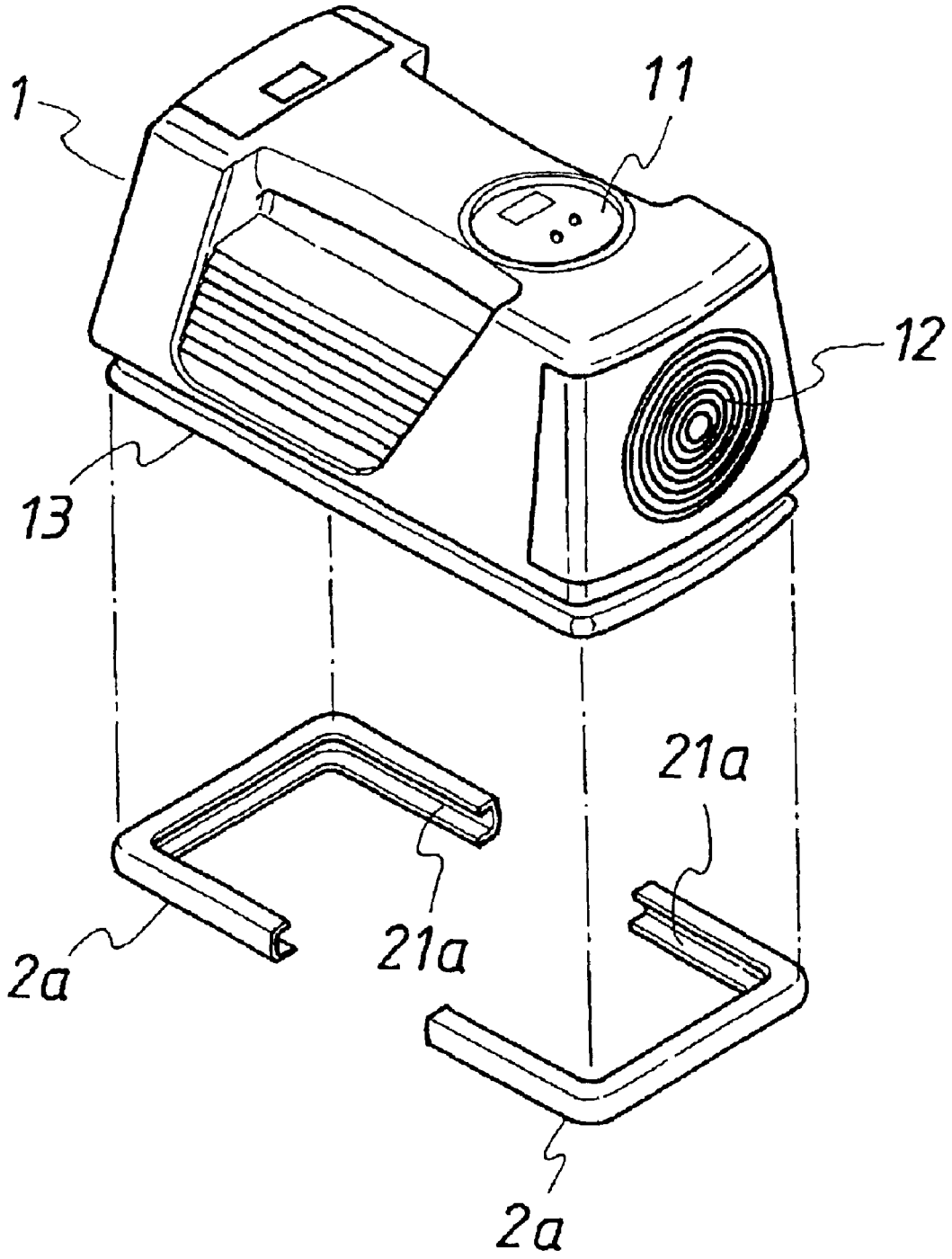
FIG. 3 is an exploded perspective view of the second embodiment of the present invention.

Referring to FIGS. 1 to 3, the air compressor with shock-absorption rubber strips at a bottom thereof of the present invention is illustrated. The air compressor with shock-absorption rubber strips at a bottom thereof includes an air compressor 1 and at least one shock-absorption rubber strip 2 or 2*a*.

The air compressor 1 is a conventional air compressor with an electromotive device therein. The outer side of the air compressor 1 is installed with a pressure indicator 11 or an illuminator 12.

Figure 4:
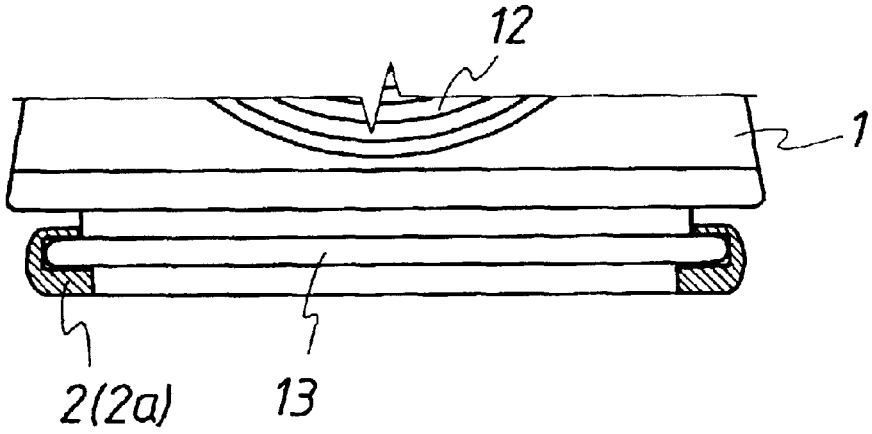
FIG. 4 is a schematic cross sectional view of the first and second embodiment of the present invention.

The shock-absorption rubber strip 2 or 2*a* is made of elastic rubbers, which may be a single close striped frame as shown in FIGS. 1 and 2 (or a single non-closed striped frame), or may be formed by two separated stripped frame (referring to FIG. 3). Each shock-absorption rubber strip 2 or 2*a* encloses in the sidewall of the air compressor bottom plate 13 (referring to FIG. 4), as shown in the figure. The side wall of shock-absorption rubber strip 2 or 2*a* installed with the air compressor bottom plate 13 have matched embedded groove 21 or 21*a* so that the engagement can be executed easily. Likewise, other than above said engagement, other ways, such as locking or gluing can be used to achieve the same effect.

The elastic shock-absorption rubber strip 2 or 2*a* is installed to the air compressor bottom plate 13, so that when the air compressor 1 is actuated, the shock-absorption rubber strip 2 or 2*a* will absorb the vibration of the casing of the air compressor 1 so as to assure that the air compressor 1 is stood at the original place. Thereby, the air compressor 1 will not displace as it is started.

Figure 5:
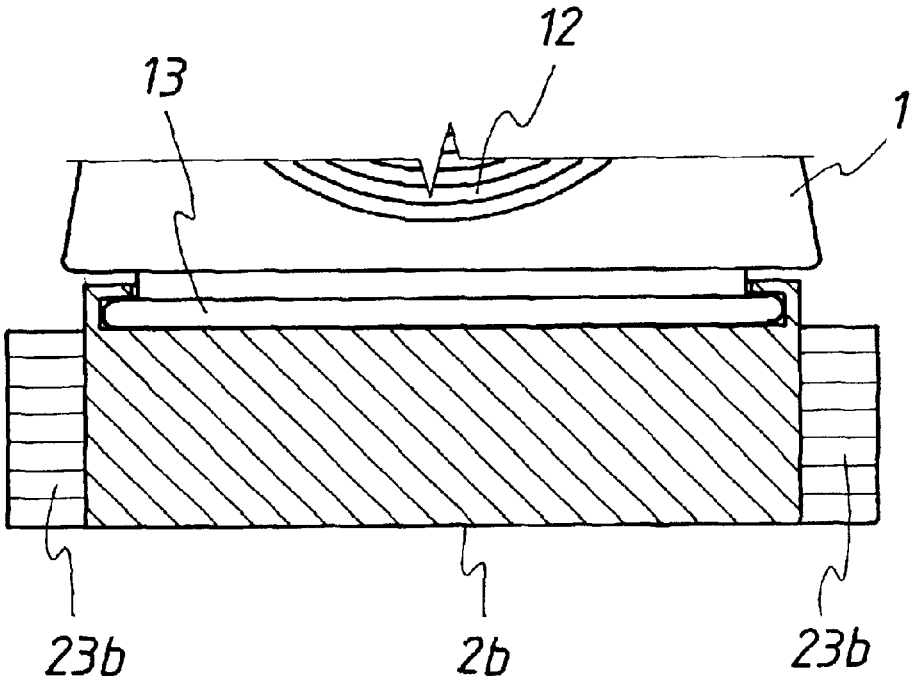
FIG. 5 is an assembled schematic view of the third embodiment of the present invention.
Figure 6:
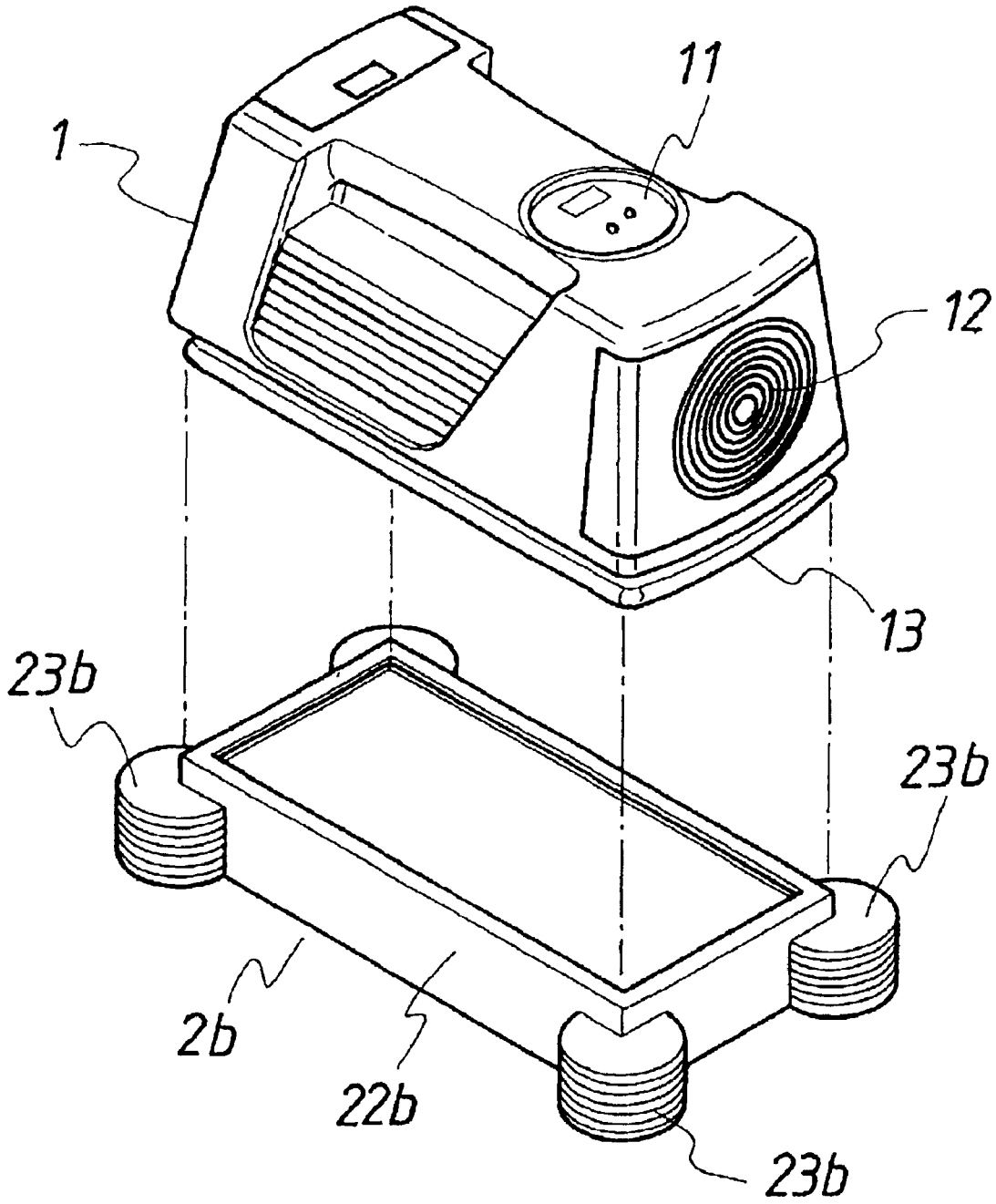
FIG. 6 is an exploded perspective view of the third embodiment of the present invention.
Figure 7:
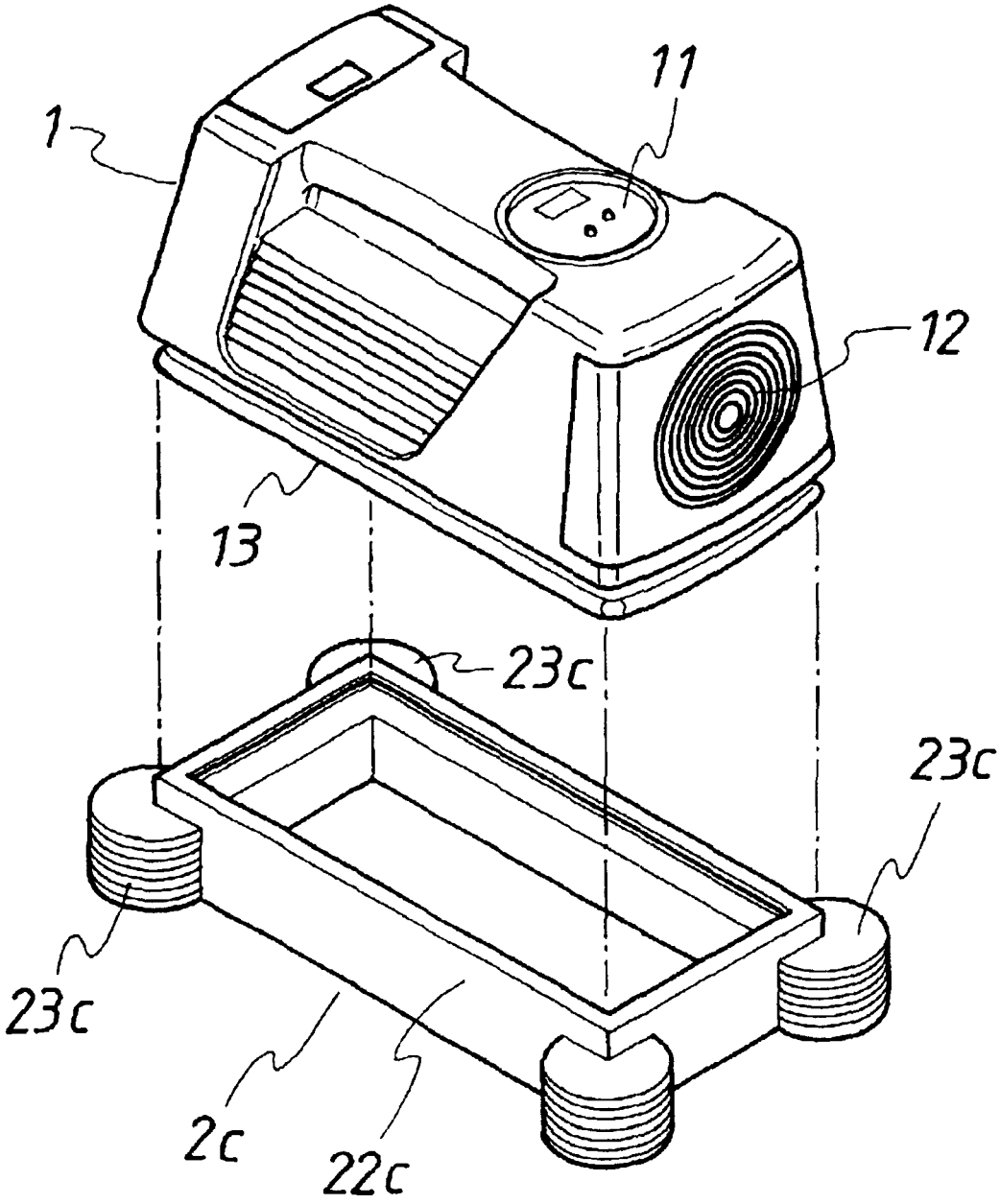
FIG. 7 is an exploded perspective view of the fourth embodiment of the present invention.

Referring to FIGS. 5 and 6, another embodiment of the shock-absorption rubber strip 2*b* of the present invention is illustrated. In that a lower end of the shock-absorption rubber strip and a selected lateral side are integrally formed with a frame seat 22*b* and at least one food pad 23*b* so that the shock-absorption rubber strip 2*b* can be fixed and combined to the lateral wall of the air compressor bottom plate 13. In another case, as shown in FIG. 17, other than the shock-absorption rubber strip and a selected lateral side being integrally formed with a frame seat 22*c* and at least one food pad 23*c*, the frame seat 22*c* may have a hollow structure (referring to FIGS. 5 and 6, in that the frame seat 22 has a solid structure).

Likewise, the shock-absorption rubber strip 2*b* or 2*c* may be locked or sticky to the air compressor bottom plate 13 other than fixing by embedding so as to achieve the same effect.

Figure 8:
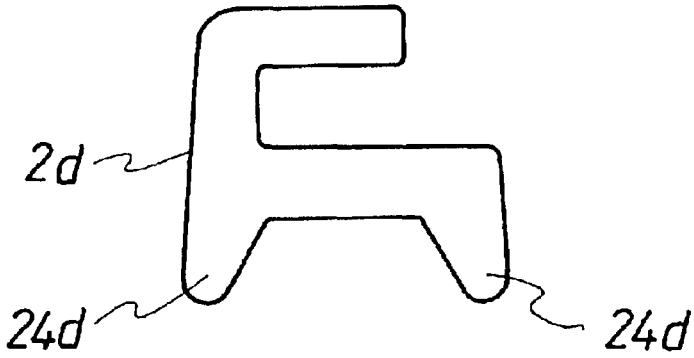
FIG. 8 shows an end surface of the fifth embodiment of shock-absorption rubber strip in the present invention.

Referring to FIG. 8, another embodiment of the shock-absorption rubber strip 2*d* is illustrated. A lower end portion of the frame-like rubber strip 2*d* is formed with at least one supporter 24*d* for enhancing the shock-absorption ability.

Figure 9:
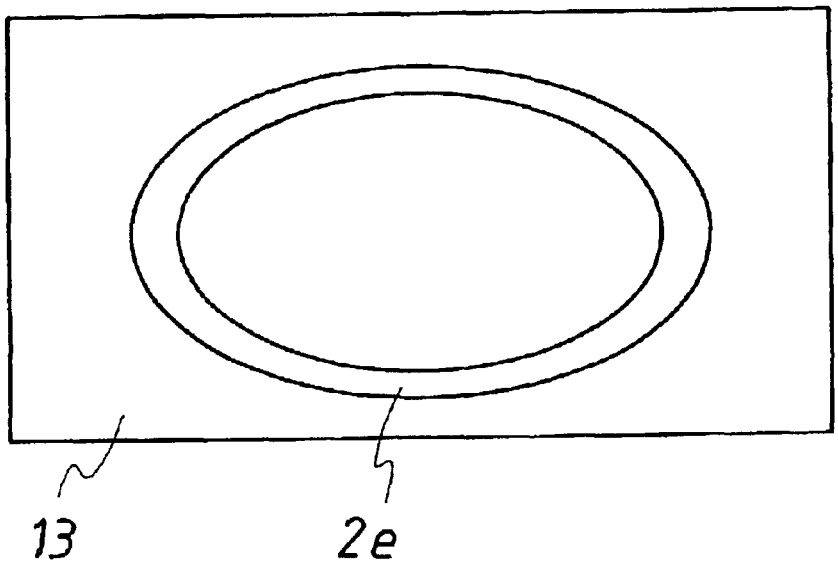
FIG. 9 is a schematic view showing the shape of the shock-absorption rubber strip of the present invention.
Figure 10:
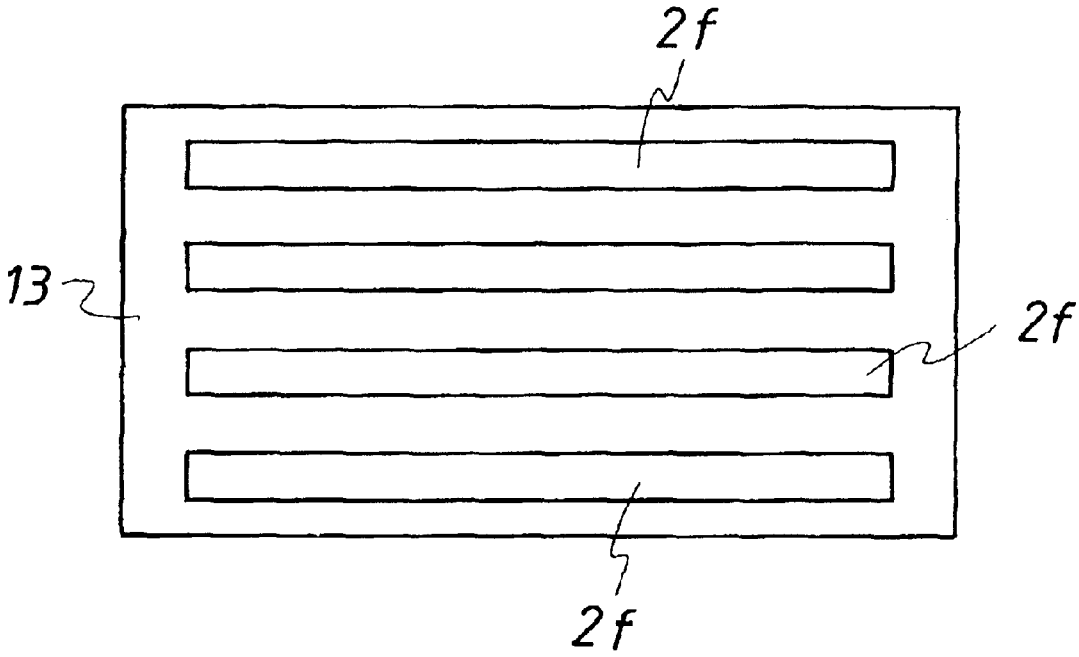
FIG. 10 is a schematic view about the seventh embodiment of the shock-absorption rubber strip where the shock-absorption rubber strip is distributed straightly.
Figure 11:
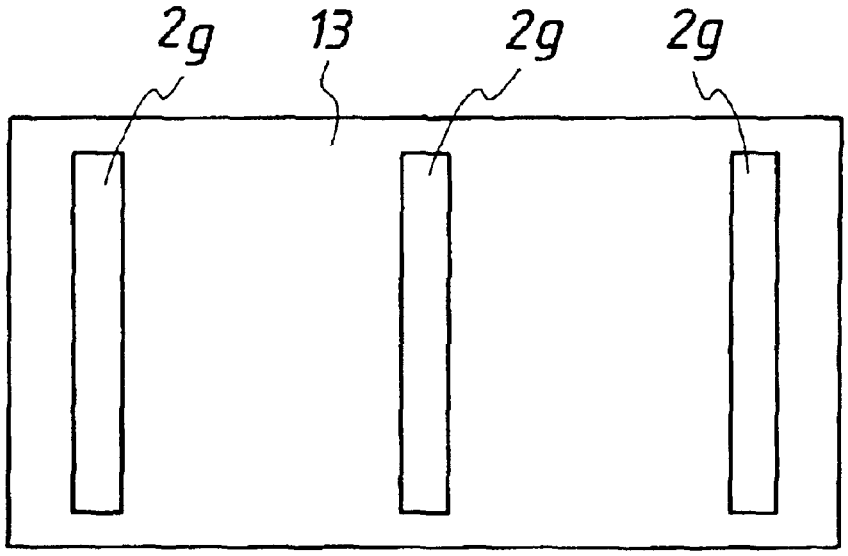
FIG. 11 is a schematic view of the eighth embodiment showing that the shock-absorption rubber strip is transversally arranged.
Figure 13:
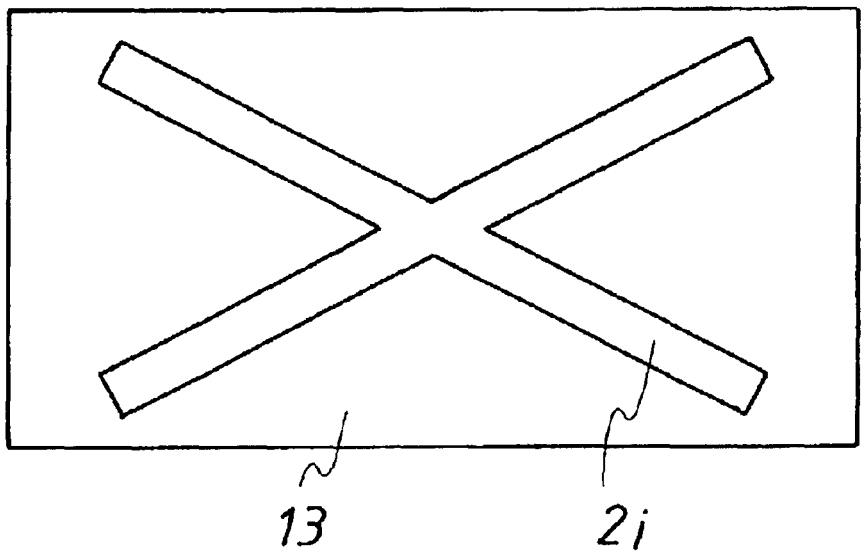
FIG. 13 is a schematic view includes the tenth embodiment showing that the shock-absorption rubber strip has a cross shape.
Figure 12:
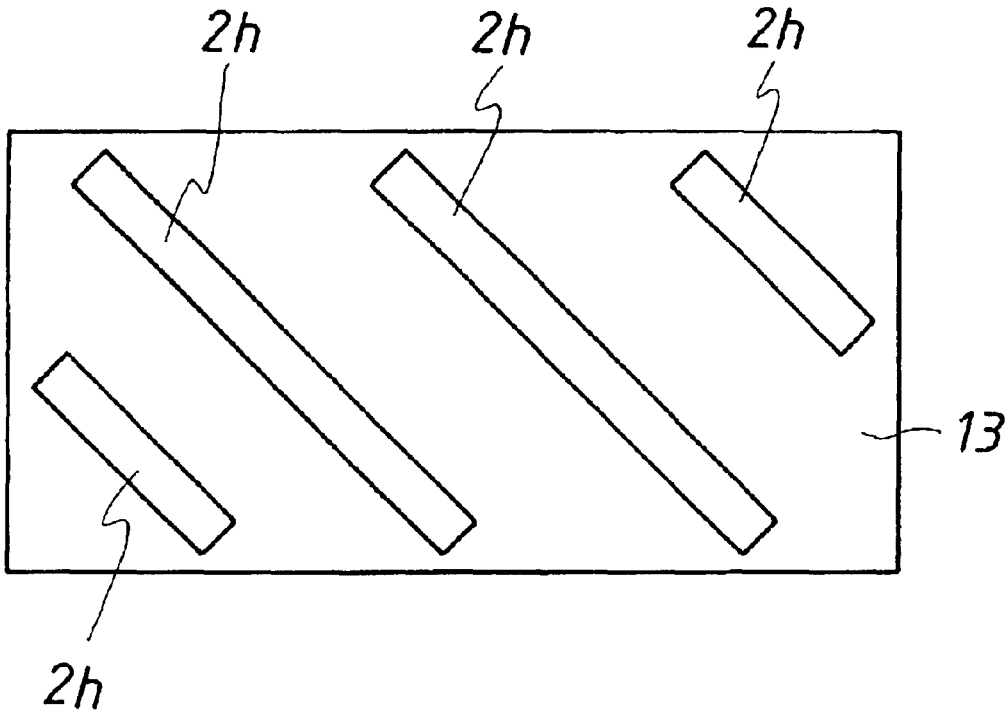
FIG. 12 is a schematic view of the eighth embodiment showing that the shock-absorption rubber strip is obliquely arranged.

The present invention is thus described, it will be obvious that the same may be varied in many ways. For example, the at least one shock-absorption rubber strip at the air compressor bottom plate is not confined to the lateral wall of the air compressor bottom plate, for example, in FIG. 9, the shock-absorption rubber strip 2*e* may be any proper shape to be firmly secured to the air compressor bottom plate 13, or as shown in FIGS. 10 to 12, the shock-absorption rubber strips 2*f*, 2*g*, 2*h*, etc. can be combined to the air compressor bottom plate 13 straightly, transversally or obliquely. Moreover, the shock-absorption rubber strip 2*i* may be arranged with a cross form and then is combined to the air compressor bottom plate 13 so that as the air compressor 1 is actuated, the air compressor absorbs the vibration of the casing as to achieve the object of no displacement. Such variations are not to be regarded as a departure from the spirit and scope of the present invention, and all such modifications as would be obvious to one skilled in the art are intended to be included within the scope of the following claims.

What is claimed is:

1. An air compressor with shock-absorption rubber strips at a bottom thereof; the air compressor comprising an air compressor bottom plate; wherein:

at least one shock-absorption rubber strip is installed to the air compressor bottom plate;

the at least one shock-absorption rubber strip is secured to the air compressor bottom plate;

the at least one shock-absorption rubber strip is installed with a plurality of elastic foot pads so that when the air compressor is actuated, the plurality of elastic foot pads will absorb the shock of the air compressor;

the at least one shock-absorption rubber strip has an inner wall formed with a loop-shaped embedding groove; and the air compressor bottom plate has an outer wall formed with a loop-shaped protrusion inserted into the loop-shaped embedding groove of the at least one shock-absorption rubber strip.

2. The air compressor with shock-absorption rubber strips at a bottom thereof as claimed in claim 1, wherein the at least one shock-absorption rubber strip is formed by at least two substantially U-shaped separated frame strips.

3. The air compressor with shock-absorption rubber strips at a bottom thereof as claimed in claim 1, wherein a lower end of the at least one shock-absorption rubber strip is formed with at least one supporter.

* * * * *